US011649829B2

(12) United States Patent
Gebert et al.

(10) Patent No.: US 11,649,829 B2
(45) Date of Patent: May 16, 2023

(54) IMPELLER WITH A SEAMLESS CONNECTION OF THE IMPELLER BLADES TO A DISC BODY

(71) Applicant: ebm-papst Mulfingen GmbH & Co. KG, Mulfingen (DE)

(72) Inventors: Daniel Gebert, Öhringen (DE); Niels Blaha, Bad Mergentheim (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 0 days.

(21) Appl. No.: 17/327,906

(22) Filed: May 24, 2021

(65) Prior Publication Data

US 2021/0372426 A1 Dec. 2, 2021

(30) Foreign Application Priority Data

May 28, 2020 (DE) ..... 10 2020 114 389.3

(51) Int. Cl.
*F04D 29/30* (2006.01)
*F04D 29/66* (2006.01)

(52) U.S. Cl.
CPC ..... *F04D 29/30* (2013.01); *F04D 29/666* (2013.01); *F05D 2240/304* (2013.01)

(58) Field of Classification Search
CPC ... F04D 29/30; F04D 29/666; F05D 2240/304
USPC ..... 416/185
See application file for complete search history.

(56) References Cited

U.S. PATENT DOCUMENTS

| | | | | |
|---|---|---|---|---|
| 3,224,079 | A * | 12/1965 | Dybvig | B21D 53/267 29/889.4 |
| 4,428,717 | A * | 1/1984 | Catterfeld | F04D 7/04 415/217.1 |
| 9,022,742 | B2 * | 5/2015 | Miller | F01D 5/34 416/186 R |
| 9,441,491 | B2 * | 9/2016 | Kim | F01D 5/225 |
| 9,945,388 | B2 * | 4/2018 | Palomba | F04D 17/10 |
| 9,989,073 | B2 * | 6/2018 | Hwang | F04D 29/666 |
| 2010/0202886 | A1 * | 8/2010 | Iwata | F04D 29/282 416/182 |
| 2010/0202887 | A1 * | 8/2010 | Bohl | F04D 29/681 416/183 |

(Continued)

FOREIGN PATENT DOCUMENTS

| | | | |
|---|---|---|---|
| DE | 102014006756 | A1 | 11/2015 |
| EP | 2218917 | A1 | 8/2010 |

(Continued)

OTHER PUBLICATIONS

German Search Report dated Aug. 13, 2021 in corresponding German Application No. 102020114389.3.

*Primary Examiner* — Hung Q Nguyen
*Assistant Examiner* — Anthony Donald Taylor, Jr.
(74) *Attorney, Agent, or Firm* — Harness, Dickey & Pierce, P.L.C.

(57) ABSTRACT

An impeller with impeller blades arranged around a rotational axis of the impeller. Integral, seamless, and notch-free transitions are formed into a disc body on at least one of their two axial sides. The disc body connects the impeller blades in the circumferential direction around the rotational axis. Covering portions, between the impeller blades, determine the flow channels of the impeller.

14 Claims, 3 Drawing Sheets

(56) References Cited

U.S. PATENT DOCUMENTS

| | | | | |
|---|---|---|---|---|
| 2010/0329871 | A1* | 12/2010 | Cahill | F04D 29/626<br>416/187 |
| 2011/0211963 | A1* | 9/2011 | Bohl | F04D 29/661<br>416/179 |
| 2011/0318183 | A1* | 12/2011 | Noronha | B23P 15/006<br>416/189 |
| 2012/0045338 | A1* | 2/2012 | Tadokoro | F04D 29/30<br>416/196 R |
| 2012/0141261 | A1* | 6/2012 | Giovannetti | F04D 29/2227<br>415/203 |
| 2015/0316069 | A1* | 11/2015 | Cocks | F04D 29/281<br>29/889.4 |
| 2015/0316073 | A1* | 11/2015 | Lörcher | F04D 29/30<br>425/468 |

FOREIGN PATENT DOCUMENTS

| | | | | |
|---|---|---|---|---|
| JP | 2008223741 | A * | 9/2008 | F04D 29/281 |
| WO | WO2019048241 | A1 * | 3/2019 | F04D 29/281 |

* cited by examiner

IMPELLER WITH A SEAMLESS CONNECTION OF THE IMPELLER BLADES TO A DISC BODY

CROSS-REFERENCE TO RELATED APPLICATION

This application claims priority to German Patent Application No. 102020114389.3 filed May 28, 2020. The entire disclosure of the above application is incorporated herein by reference.

FIELD

The disclosure relates to an impeller with a seamless connection of the impeller blades to a disc body.

BACKGROUND

Impellers with impeller blades arranged between a bottom disc and a cover disc are known from the prior art. The impeller blades are connected in an abutting manner to the bottom disc and/or cover disc. Such impellers are disclosed in printed publication EP 2218917 B1, for example. The contours of the cover disc and/or bottom disc are implemented in different designs. However, there is always a notch at the abutting point of a connection between the impeller blades and the bottom disc and cover disc.

This notch is a critical area of the fan impellers both rheologically and mechanically, since, on the one hand, undesirable eddies form here, that have a negative effect on efficiency and noise generation, and, on the other hand, stresses in the glass wheels limit speed stability.

SUMMARY

It is therefore the object of the disclosure to provide an impeller that is improved in terms of efficiency, noise generation, and speed stability.

This object is achieved by an impeller comprising impeller blades arranged around a rotation axis of the impeller. Integral, seamless, and notch-free transitions are formed into a disc body on at least one of their two axial sides. The disc body connects the impeller blades in the circumferential direction around the rotation axis. Covering portions, between the impeller blades, determine flow channels of the impeller.

According to the disclosure, an impeller has impeller blades that are arranged in a blade ring around a rotation axis of the impeller. The impeller blades form integral, seamless, and notch-free transitions into a disc body on at least one of their two axial sides. The disc body connects the impeller blades in the circumferential direction around the rotation axis. Covers portions, between the impeller blades, define the flow channels of the impeller.

The disc body thus simulates the cover disc that is known from the prior art, or optionally also the bottom disc. The impeller blades merge into the disc body integrally without a point of connection. Of course, it can also be viewed in such a way that the disc body merges accordingly into the impeller blades. Although there are one-piece impellers in the prior art, the connection between the impeller blades and the cover disc and the bottom disc each have a notch. Accordingly, no seamless transition is formed. In contrast, the disclosure determines a course between the impeller blades and the disc body(s) where no points of connection are provided, but rather seamless, notch-free transitions.

In one advantageous embodiment, in the impeller, when viewed from the side, the transitions from the impeller blades to the disc bodies are each rounded in an arc shape. Such a configuration is particularly favorable in terms of the efficiency, the noise generation, and the speed stability of the impeller.

Also advantageous in the case of the impeller is a configuration where, when the impeller is viewed from the side, the disc body has an elliptical contour in the portions between the impeller blades together with the transitions. In viewing the impeller from the side and looking at two adjacent impeller blades with the disc body connecting them, the two transitions between the impeller blades and the disc body portion, between the impeller blades, form a half-ellipse. The impeller blades then extend further axially to the oppositely situated disc body.

The disc body is preferably designed so that, on one side, it forms an axial inlet opening of the impeller and delimits a radial exhaust opening of the impeller. Thus, the disc body also assumes the function of the cover discs known from the prior art.

As described above, the disc body can simulate the bottom disc and/or cover disc known from the prior art. However, it is an advantageous embodiment of the impeller where the disc body simulates the cover disc and the impeller comprises a bottom disc with or forming a hub of the impeller. The hub forms the interface to the motor. The impeller blades are attached to or formed on the bottom disc.

In the case of the impeller, one further-developing embodiment makes a provision where the impeller blades each extend over a blade length from a blade leading edge to a blade trailing edge. The impeller blades are divided into a front portion, a rear portion and a transition portion. The front portion extends from the front edge of the blade toward the rear edge of the blade. The rear portion extends from the rear edge of the blade toward the front edge of the blade. The transition portion forms a transition between the front portion and the rear portion. The impeller blades in the front portion and the rear portion are embodied to be oppositely curved over the course between the disc body and the bottom disc.

In a variant of this impeller, the impeller blades in the front portion and the rear portion are embodied so as to be opposed, particularly curved three-dimensionally, across from a shortest connection between the disc body and the bottom disc.

In an advantageous embodiment, the impeller blades are curved in an arc shape. The arc-shaped path preferably has a constant or substantially constant arc radius.

One embodiment of the impeller is also advantageous where the front portion extends over at least 5%, preferably over 10-40% of the blade length. Similarly, it is advantageous where the rear portion extend over at least 5%, preferably over 10-40% of the blade length.

In the case of the impeller, the transition portion connects the front portion and the rear portion. In particular, the transition takes place in a steady progression along the length of the blade. The alternation of the curvature of the front portion and the rear portion, the opposing curvature in the front portion and the rear portion, is preferably implemented in the transition portion by a uniform progression.

One exemplary advantageous embodiment of the impeller, in terms of rheology, makes a provision where the front portion is curved toward the rotation axis and the rear portion is curved away from the rotation axis.

Furthermore, in one embodiment, the impeller bottom disc has an elliptical cross section on its radial outer edge portion. Thus, its radial outer edge runs parallel or substantially parallel to the rotation axis.

In an advantageous embodiment of the impeller, the impeller blades extend radially outward and around the rotation axis from the blade leading edge to the blade trailing edge. The impeller blades are thus curved forward or backward relative to the direction of rotation.

The impeller according to the disclosure is embodied particularly as a radial impeller or diagonal impeller. The impeller is preferably made of one piece, particularly of plastic. However, the use of multi-part impellers made of metal, particularly sheet metal, is also possible.

Other advantageous further developed embodiments of the disclosure are disclosed in the dependent claims and/or are described in more detail through the drawings in conjunction with the description of the preferred embodiment of the disclosure.

DRAWINGS

Other advantageous developments of the disclosure are characterized in the subclaims and/or depicted in greater detail below together with the description of the preferred embodiment of the disclosure with reference to the figures. In the drawing:

DETAILED DESCRIPTION

Figure 1:
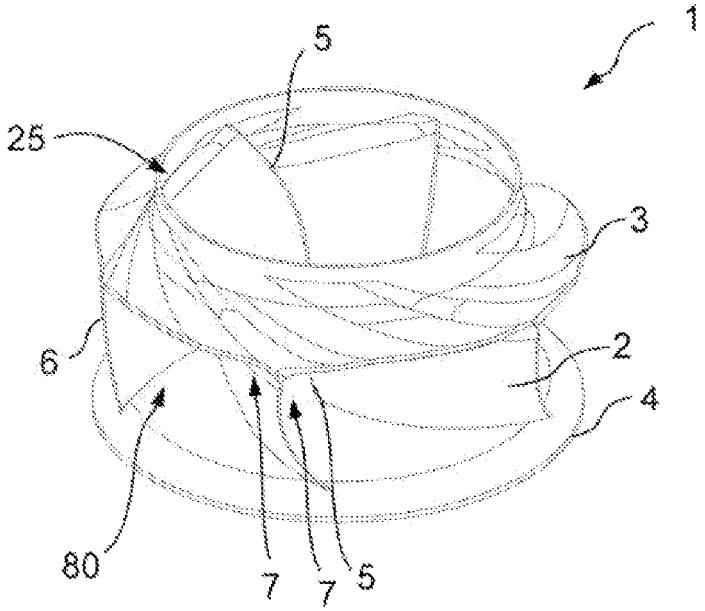
FIG. 1 is a perspective view of an impeller in a first exemplary embodiment.
Figure 2:
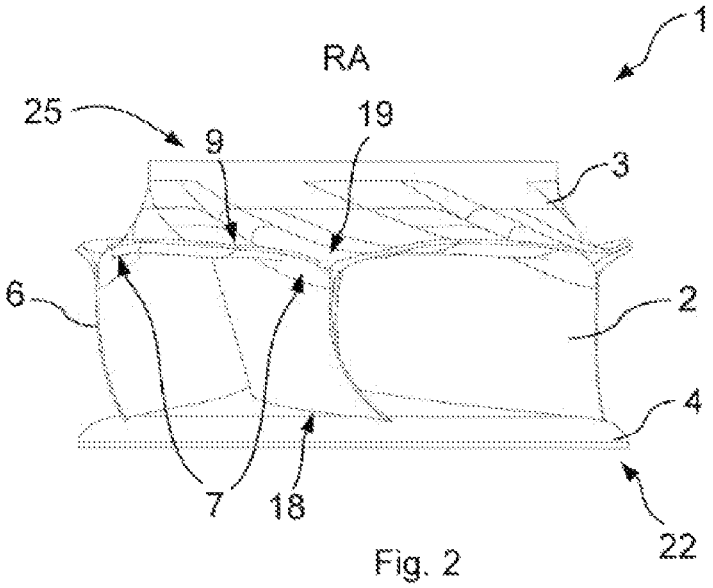
FIG. 2 is a side view of the impeller of FIG. 1.

FIGS. 1 and 2 show a first embodiment of an impeller 1 that is embodied as a radial impeller with a plurality of impeller blades 2 arranged in a blade ring around the rotation axis RA. The impeller blades 2 are curved in the circumferential direction around the rotation axis RA from the hub, starting from their respective blade leading edge 5 to their respective blade trailing edge 6, and extend radially outward over their respective blade length. On the axial inlet side, the impeller blades 2 each form integral, seamless and notch-free transitions 7 into the disc body 3. The transitions 7 connect the impeller blades 2 in the circumferential direction around the rotation axis RA in the manner of a cover disc and covers the portions 9 between the impeller blades 2. The disc body 3 forms the axial intake opening 25. The edge of the intake opening 25 is formed by a portion of the disc body 3 that extends parallel to the rotation axis RA. Flow channels 80 of the impeller 1 are defined between the respective impeller blades 2 and the disc body 3, forming radial blowout openings.

The transitions 7, from the impeller blades 2 to the integrally connected disc body 3, run seamlessly and without notches, with an arcuate contour of the blade trailing edge 6, being curved radially outward from the rotation axis RA, flowing over a rounded portion into the disc body 3. In the side view of the impeller 1 according to FIG. 2, it is easy to see how the transitions 7 are each rounded in an arc shape and continue a arching or curvature of the blade trailing edge 6. In this embodiment, the convex arching or curvature of the impeller blades 2 radially outward remains along the respective blade length from the blade leading edge 5 to the blade trailing edge 6, with respect to the rotation axis, in the same direction. Only the extent of the arching or curvature can change along the length of the blade.

The shape of the impeller blades 2 on the disc body 3 is repeated on all the impeller blades 2. Thus, the portions 9 between the individual impeller blades 2 together with the respective transitions 7 each form an elliptical contour in the form of a half ellipse, as can also be seen clearly in the side view according to FIG. 2. As a result, curved V-shaped axial notches 19 are formed on the disc body 3 on the inlet side.

The impeller 1 also has the bottom disc 4 where the impeller blades are abuttingly joined in one piece along the connection 18. The impeller blades 2 run into the bottom disc at an angle relative to the rotation axis RA, see FIG. 2. In its radial outer edge portion 22, the bottom disc 4 has an elliptical cross section and changes from an extension radially outward to an axial extension. Thus, the radial outer edge of the bottom disc 4 runs parallel or substantially parallel to the rotation axis RA.

Figure 3:
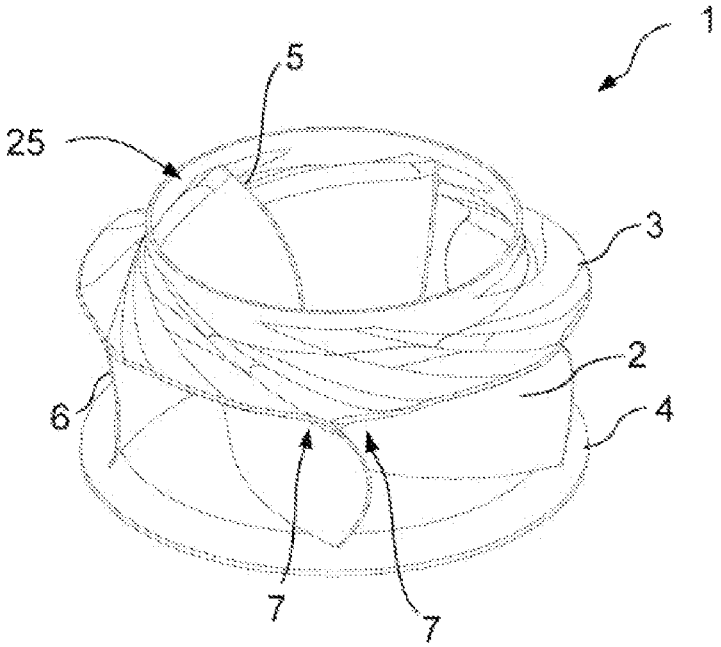
FIG. 3 is a perspective view of an impeller of a second exemplary embodiment.
Figure 4:
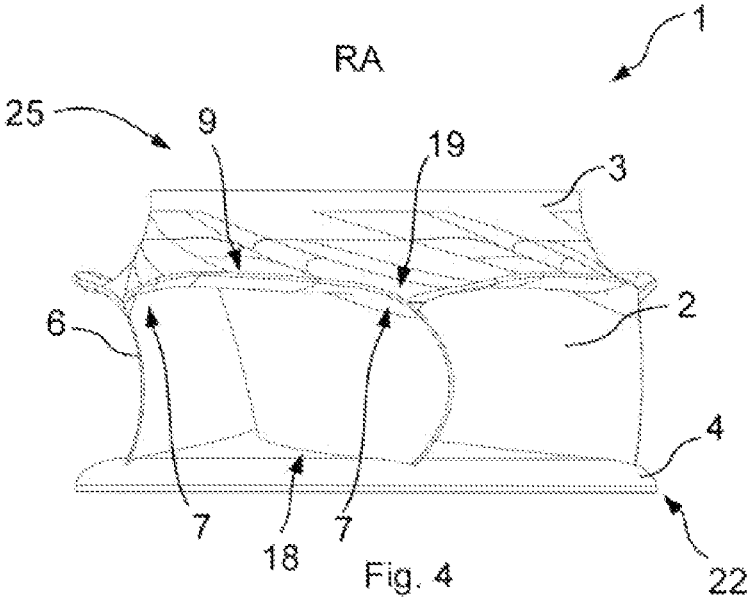
FIG. 4 is a side view of the impeller of FIG. 2.

FIGS. 3 and 4 show a second exemplary embodiment where the features identical to those in the embodiment according to FIG. 1 are not repeated again but are regarded as having been disclosed through the present reference. The same reference symbols denote the same features. In contrast to the design of the impeller 1 from FIGS. 1 and 2, the arching or curvature of the impeller blades 2 is situated opposite the rotation axis RA, convexly oriented radially inward to the rotation axis. In this embodiment, the convex arching or curvature radially inward of the impeller blades 2 remains along the respective blade length from the blade leading edge 5 to the blade trailing edge 6, relative to the rotation axis RA, in the same direction. Only the extent of the arching or curvature can change along the length of the blade.

Figure 5:
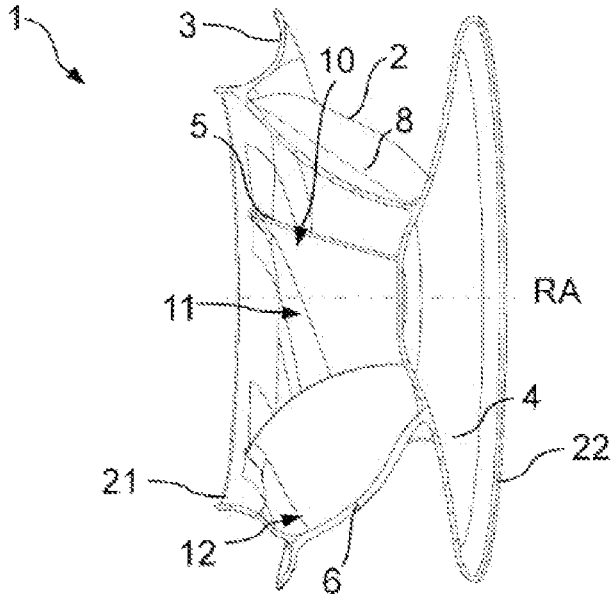
FIG. 5 is a perspective cross-sectional view of an impeller in another exemplary embodiment.

FIG. 5 shows another exemplary embodiment of an impeller 1 in a lateral sectional view. The shape of the disc body 3 and the transitions 7, from the impeller blades 2 to the disc body 3, correspond to those of the exemplary embodiments in FIGS. 1-4. However, the arching or curvature of the impeller blades 2 differs from the rotation axis RA. According to FIG. 5, the impeller blades 2 at the blade leading edge 5 and the blade trailing edge 6 are embodied so as to be oppositely curved three-dimensionally over the course from the disc body 3 to the bottom disc 4. More precisely, the impeller blades 2 are divided into a front portion 10, rear portion 12 and transition portion 11. The front portion 10 extends from the blade leading edge 5 toward the blade trailing edge 6. The rear portion 12 extends from the blade trailing edge 6 toward the blade leading edge 5. The transition portion 11 forms a transition between the front portion 10 and the rear portion 12. The front portion 10 and the rear portion 12 each extend over approximately 30% of the total blade length. The transition portion 11 between them occupies the remainder.

The transition portion 11 has a steady progression along the blade length. Thus, the change in direction of the curvature of the impeller blades 2 from the front portion 10 to the rear portion 12 takes place uniformly over the entire axial height of the impeller blades 2 and without a step. According to FIG. 5, the impeller blades 2 are curved in the front portion 10 and the rear portion 12 in such a way that the impeller blades 2 in the front portion 10 and the rear portion 12 are curved three-dimensionally opposite a shortest connection between the disc body 3 and the bottom disc 4.

Figure 6:
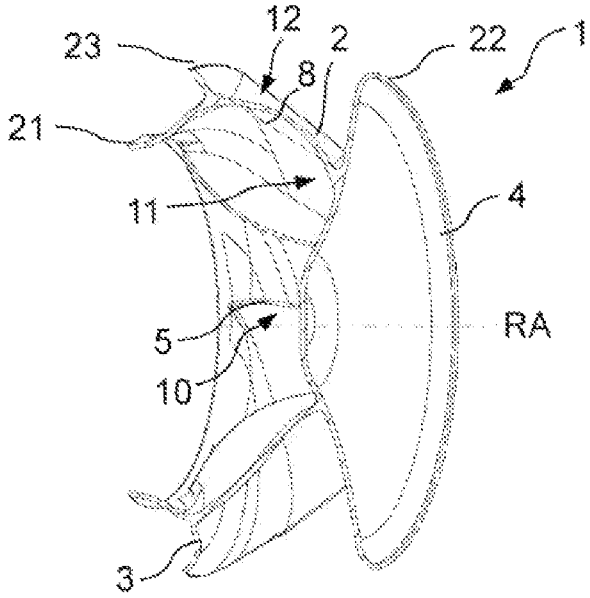
FIG. 6 is a further perspective cross-sectional view of an impeller in another exemplary embodiment.

In the embodiment shown in FIG. 5, the curvature occurs away from the rotation axis in the front portion 10 and toward the rotation axis in the rear portion 12. In the exemplary embodiment according to FIG. 6, it is exactly the opposite. The impeller blades 2 are curved toward the rotation axis in the front portion 10 and away from the rotation axis in the rear portion 12. The other features correspond to those from FIG. 5. The respective shortest connection between the bottom disc 4 and the disc body 3 is indicated by the straight line 8. Thus, the curvature in the rear portion 12 can be better grasped.

The disc body 3 is specially shaped in all exemplary embodiments. When viewed from radially inside to radially outside, it has a first portion 21 that extends axially parallel to the rotation axis RA and defines the intake opening 25. As seen in lateral cross section, this is followed by an arcuately curved progression that covers the impeller blades 2 and merges again in the radial outer edge portion 23 like a winglet in the axial direction parallel to the rotation axis RA. The disc body 3 thus undergoes a complete axial change of direction over its radial extension. The impeller blades 2 and the blade body 3 end together radially on the outside. Thus, the disc body 3 neither protrudes beyond the impeller blades 2 nor is it set back relative thereto.

The disclosure is not limited in its execution to the abovementioned preferred exemplary embodiments shown in the figures. On the contrary, the described variants are also included, particularly including the connection of the bottom disc as a disc body to the impeller blades 2 appropriately with transitions 7.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An impeller comprising:

a plurality of impeller blades, each impeller blade extending radially outward from a rotation axis of the impeller and arranged in a circumferential direction around the rotation axis of the impeller, each impeller blade including a leading edge and a trailing edge;

a disc body connecting each impeller blade in the circumferential direction around the rotation axis of the impeller;

a plurality of integral, seamless, and notch-free transitions, each transition provided at the trailing edge of the respective impeller blade, each transition rounded in a convex arc shape that extends from the disc body and continues along an arching or curvature of the trailing edge; and a plurality of covering portions formed between the transitions of adjacent impeller blades, each covering portion defining a flow channel of the impeller, wherein a radially outer portion of the disc body has an elliptical contour formed by each covering portion between adjacent impeller blades, the elliptical contour including the respective transition.

2. The impeller as set forth in claim 1, wherein the disc body forms an axial inlet opening of the impeller and delimits a radial blowout opening of the impeller.

3. The impeller as set forth in claim 1, wherein the impeller has a bottom disc forming a hub of the impeller, the hub forming an interface to a motor, wherein each impeller blade is attached to or formed on the bottom disc.

4. The impeller according to claim 3, wherein the disc body faces the bottom disc.

5. The impeller as set forth in claim 3, wherein each impeller blade extends over a blade length from the leading edge to the trailing edge, such that each impeller blade includes a front portion, a rear portion, and a transition portion, wherein the front portion extends from the leading edge toward the trailing edge, the rear portion, starting from the trailing edge, extends toward the leading edge, and the transition portion is formed between the front portion and the rear portion, and wherein the front portion and the rear portion are oppositely curved over a course between the disc body and the bottom disc.

6. The impeller as set forth in claim 5, wherein the front portion and the rear portion are embodied so as to be curved in opposite directions across a connection between the disc body and the bottom disc.

7. The impeller as set forth in claim 5, wherein each impeller blade is curved in an arc shape that extends between the disc body and the bottom disc.

8. The impeller as set forth in claim 5, wherein the front portion extends over at least 5%, preferably between 10-40% of the blade length.

9. The impeller as set forth in claim 5, wherein the rear portion extends over at least 5%, preferably between 10-40% of the blade length.

10. The impeller as set forth in claim 5, wherein the transition portion has a continuous progression along the blade length.

11. The impeller as set forth in claim 5, wherein the front portion is curved toward the rotation axis and the rear portion is curved away from the rotation axis.

12. The impeller as set forth in claim 3, wherein a radially outer portion of the bottom disc has an elliptical cross section, such that an edge of the radially outer portion of the bottom disc extends parallel or substantially parallel to the rotation axis.

13. The impeller as set forth in claim 1, wherein a curved V-shaped axial notch is formed on the disc body on an inlet side of the impeller above the trailing edge of the respective impeller blade.

14. The impeller as set forth in claim 1, wherein the impeller is a one-piece radial impeller or diagonal impeller.

* * * * *